US011674514B2

(12) United States Patent
Masuda

(10) Patent No.: US 11,674,514 B2
(45) Date of Patent: Jun. 13, 2023

(54) COMPRESSOR WITH A FITTED SHAFT PORTION HAVING TWO SLIDING SURFACES AND AN OIL RETAINER

(71) Applicant: DAIKIN INDUSTRIES, LTD., Osaka (JP)

(72) Inventor: Masanori Masuda, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/842,254

(22) Filed: Jun. 16, 2022

(65) Prior Publication Data

US 2022/0307498 A1 Sep. 29, 2022

Related U.S. Application Data

(63) Continuation of application No. PCT/JP2020/044495, filed on Nov. 30, 2020.

(30) Foreign Application Priority Data

Dec. 17, 2019 (JP) ..... JP2019-227029

(51) Int. Cl.
*F04C 29/02* (2006.01)
*F04C 29/00* (2006.01)
*F04C 18/356* (2006.01)

(52) U.S. Cl.
CPC ..... *F04C 29/023* (2013.01); *F04C 18/356* (2013.01); *F04C 29/0057* (2013.01); (Continued)

(58) Field of Classification Search
CPC ..... F04C 18/356; F04C 2240/60; F04C 2240/603; F04C 2240/605; F04C 29/0057; F04C 29/023; F04C 29/028
See application file for complete search history.

(56) References Cited

U.S. PATENT DOCUMENTS 9,074,600 B2 * 7/2015 Karino ..... F04C 29/0057
2022/0307505 A1 * 9/2022 Masuda ..... F04C 29/028

FOREIGN PATENT DOCUMENTS

CN 104879301 A 9/2015
JP 56-88988 A 7/1981
(Continued)

OTHER PUBLICATIONS

International Search Report of corresponding PCT Application No. PCT/JP2020/044495 dated Jan. 19, 2021.
(Continued)

*Primary Examiner* — Mary Davis
(74) *Attorney, Agent, or Firm* — Global IP Counselors, LLP

(57) ABSTRACT

A compressor includes a drive shaft having a main shaft and an eccentric portion, and a compression mechanism having a fitted tubular portion into which a fitted shaft portion of the drive shaft is slidably fitted. The fitted shaft portion has first and second sliding surfaces formed as portions of an outer peripheral surface in the circumferential direction. The second sliding surface has a smaller axial width than the first sliding surface. A gap is adjacent to the second sliding surface into which a lubricating oil flows. An oil retainer is configured as a boundary portion between the first sliding surface and the gap to keep the lubricating oil in the gap from flowing out toward an end surface of the fitted shaft portion. The boundary portion has a central portion that protrudes further toward the first sliding surface than an end of the boundary portion in a lubricating oil flow-out direction.

6 Claims, 14 Drawing Sheets

(52) U.S. Cl.
CPC ..... *F04C 29/028* (2013.01); *F04C 2240/60* (2013.01); *F04C 2240/603* (2013.01); *F04C 2240/605* (2013.01)

(56) References Cited

FOREIGN PATENT DOCUMENTS

| | | | |
|---|---|---|---|
| JP | 5-164071 | A | 6/1993 |
| JP | 5-340370 | A | 12/1993 |
| JP | 11-166491 | A | 6/1999 |
| WO | 2017/221398 | A1 | 12/2017 |
| WO | 2019/134364 | A1 | 7/2019 |

OTHER PUBLICATIONS

International Preliminary Report of corresponding PCT Application No. PCT/JP2020/044495 dated Jun. 30, 2022.
European Search Report of corresponding EP Application No. 20 90 1818.3 dated Nov. 22, 2022.

* cited by examiner

COMPRESSOR WITH A FITTED SHAFT PORTION HAVING TWO SLIDING SURFACES AND AN OIL RETAINER

CROSS-REFERENCE TO RELATED APPLICATIONS

This is a continuation of International Application No. PCT/JP2020/044495 filed on Nov. 30, 2020, which claims priority to Japanese Patent Application No. 2019-227029, filed on Dec. 17, 2019. The entire disclosures of these applications are incorporated by reference herein.

BACKGROUND

Technical Field

The present disclosure relates to a compressor.

Background Art

A compressor that has been known in the art includes a compression mechanism including a cylinder that houses a tubular piston, and a drive shaft having an eccentric portion fitted into the piston, and the piston rotates eccentrically inside the cylinder. In some cases of this compressor, a sliding surface receiving a heavier load during compression of a working fluid, such as a refrigerant, (hereinafter referred to as the "first sliding surface") is axially wider, and a sliding surface receiving a lighter load (hereinafter referred to as the "second sliding surface") is axially narrower (see, for example, Japanese Unexamined Patent Publication No. H05-164071).

In the compressor having the above configuration, the axially narrower second sliding surface allows a lubricating oil to flow into a gap between the eccentric portion and the piston. Thus, the lubricating oil is supplied through this gap to the first sliding surface.

SUMMARY

A first aspect of the present disclosure is directed to a compressor. The compressor includes a drive shaft having a main shaft and an eccentric portion that is eccentric relative to a center of the main shaft, and a compression mechanism having a fitted tubular portion into which a fitted shaft portion of the drive shaft is fitted. The fitted shaft portion of the drive shaft and the fitted tubular portion slide relative to each other with an oil film interposed therebetween. The fitted shaft portion having a first sliding surface formed as a portion, in a circumferential direction, of an outer peripheral surface of the fitted shaft portion, and a second sliding surface formed as an other portion of the outer peripheral surface in the circumferential direction. The second sliding surface having a smaller axial width than an axial width of the first sliding surface. A sliding portion between the fitted shaft portion and the fitted tubular portion having a gap adjacent to the second sliding surface in an axial direction and into which a lubricating oil flows, and an oil retainer configured to keep the lubricating oil in the gap from flowing out toward an end surface of the fitted shaft portion. The second sliding surface is provided at an axial middle portion of the fitted shaft portion. The oil retainer is configured as a boundary portion between the first sliding surface and the gap. The boundary portion has a central portion that protrudes further toward the first sliding surface than an end of the boundary portion in a lubricating oil flow-out direction.

DETAILED DESCRIPTION OF EMBODIMENT(S)

An embodiment will be described.

Figure 1:
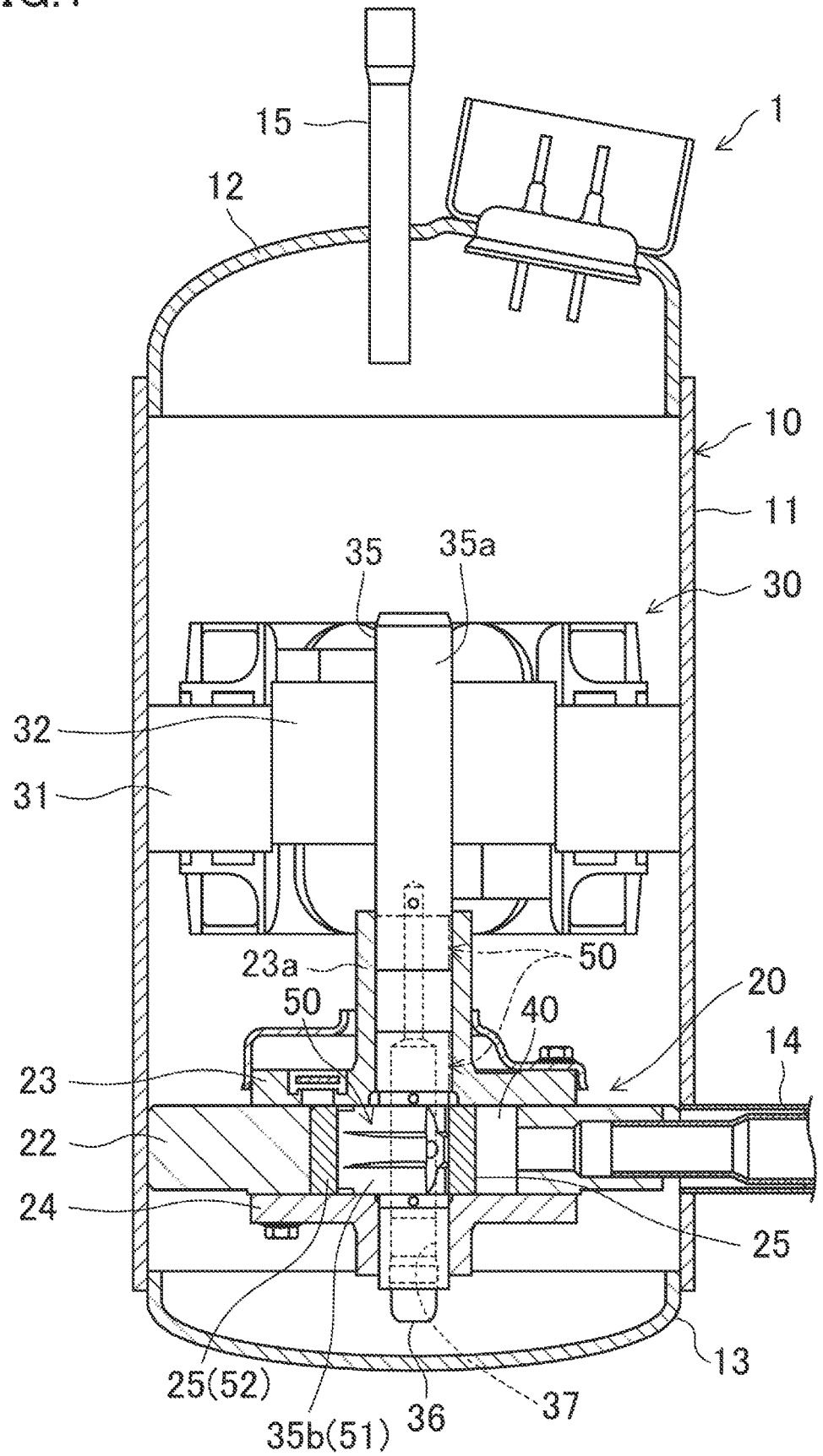
FIG. 1 is a longitudinal cross-sectional view of a compressor according to an embodiment.

FIG. 1 is a longitudinal cross-sectional view of a compressor (1) according to the embodiment. The compressor (1) is a swing piston compressor, and is connected to a refrigerant circuit for performing a refrigeration cycle.

Overall Structure

The compressor (1) includes a casing (10). The casing (10) houses a compression mechanism (20) for compressing a refrigerant in the refrigerant circuit and an electric motor (30) for driving the compression mechanism (20).

Casing

The casing (10) is configured as a vertically long cylindrical closed container. The casing (10) has a cylindrical barrel (11), an upper end plate (12) that closes an upper opening of the barrel (11), and a lower end plate (13) that closes a lower opening of the barrel (11).

The compression mechanism (20) and the electric motor (30) are fixed to an inner peripheral surface of the barrel (11).

Electric Motor

The electric motor (30) includes a stator (31) and a rotor (32), both of which are formed in a cylindrical shape. The stator (31) is fixed to the barrel (11) of the casing (10). The rotor (32) is disposed in a hollow portion of the stator (31). In the hollow portion of the rotor (32), a drive shaft (35) is fixed to pass through the rotor (32). This allows the rotor (32) and the drive shaft (35) to rotate integrally.

Drive Shaft

The drive shaft (35) includes a main shaft (35*a*) extending vertically. The drive shaft (35) further includes an eccentric portion (fitted shaft portion) (35*b*) integrated with the main shaft (35*a*) near the lower end of the main shaft (35*a*). The eccentric portion (35*b*) has a larger diameter than the main shaft (35*a*). The center axis of the eccentric portion (35*b*) is eccentric to the center axis of the main shaft (35*a*) by a predetermined distance. In this embodiment, the drive shaft (35) is made of cast iron containing graphite, but may be made of a different material.

A centrifugal pump (36) is provided at the lower end of the main shaft (35*a*). The centrifugal pump (36) is immersed in a lubricating oil in an oil reservoir formed at the bottom of the casing (10). The centrifugal pump (36) pumps up the lubricating oil into an oil supply path (37) in the drive shaft (35) along with the rotation of the drive shaft (35), and then supplies the lubricating oil to respective sliding portions of the compression mechanism (20).

Compression Mechanism

Figure 2:
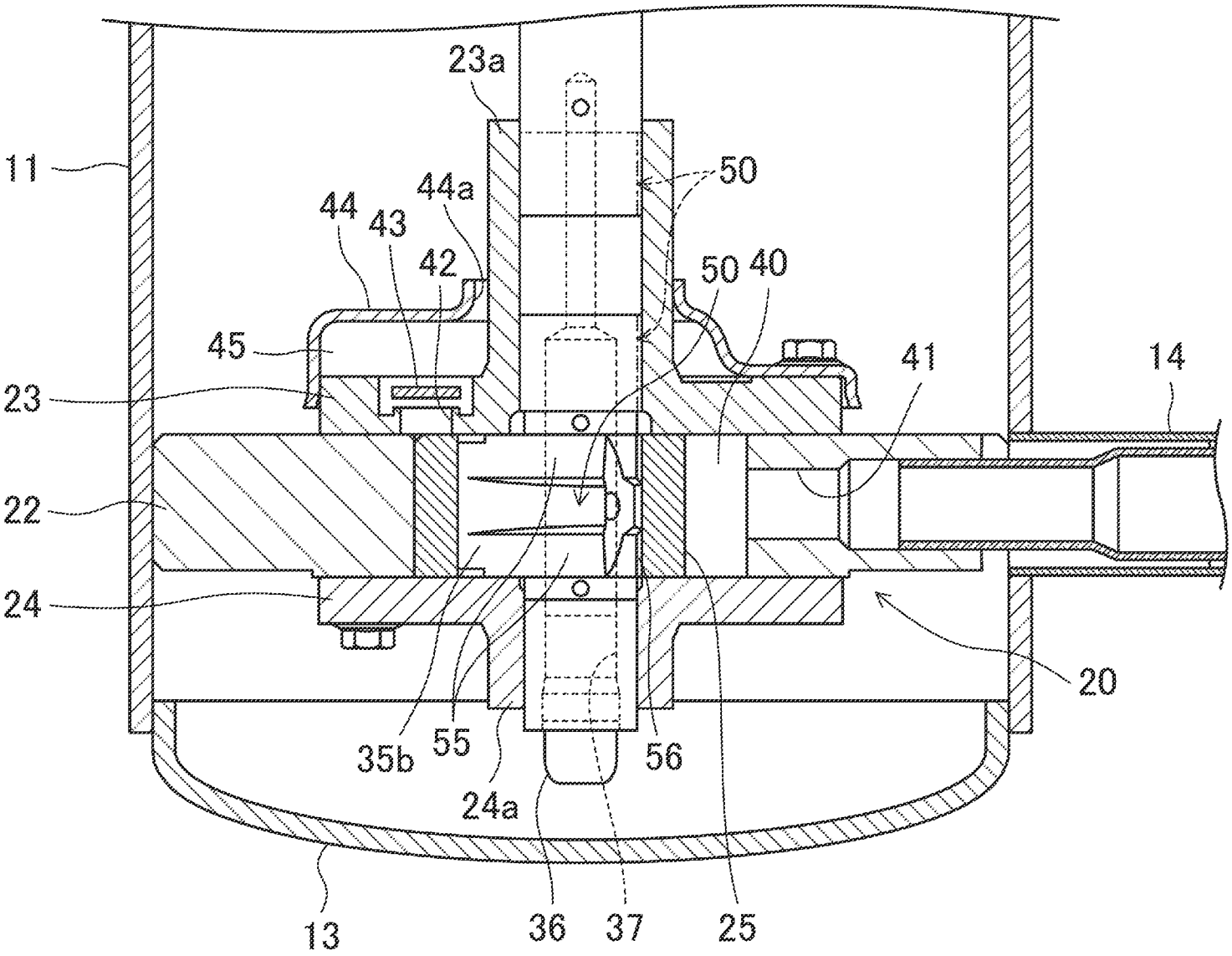
FIG. 2 is a partially enlarged view of FIG. 1.

As illustrated in FIG. 2, which is a partially enlarged view of FIG. 1, the compression mechanism (20) includes a cylinder (22) formed in an annular shape. The cylinder (22) has one axial end (upper end) to which a front head (23) is fixed, and the other axial end (lower end) to which a rear head (24) is fixed. The cylinder (22), the front head (23), and the rear head (24) are stacked in the order of the front head (23), the cylinder (22), and the rear head (24) from top to bottom, and are fastened together with a plurality of bolts extending axially.

The drive shaft (35) vertically penetrates the compression mechanism (20). The front head (23) and the rear head (24) are respectively provided with bearings (23*a*, 24*a*) supporting the drive shaft (35) both above and below the eccentric portion (35*b*).

Figure 3:
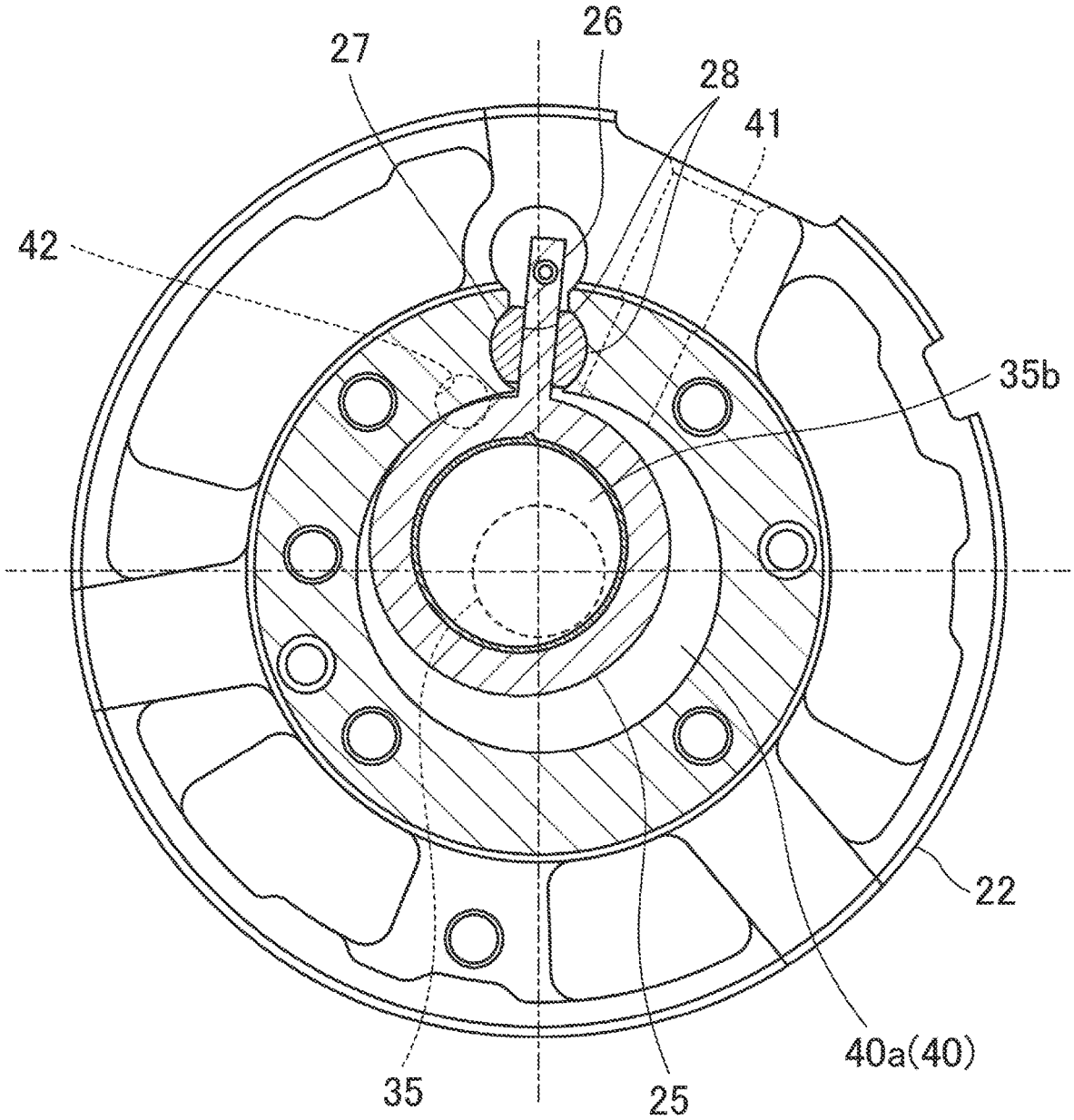
FIG. 3 is a horizontal cross-sectional view of a compression mechanism.

The cylinder (22) has its upper end closed by the front head (23), and has its lower end closed by the rear head (24). Thus, the internal space of the cylinder (22) forms a cylinder chamber (40). The cylinder (22) (the cylinder chamber (40)) houses a tubular piston (fitted tubular portion) (25) slidably fitted to the eccentric portion (35*b*) of the drive shaft (35). Rotation of the drive shaft (35) causes the piston (25) to rotate eccentrically in the cylinder chamber (40). As illustrated in FIG. 3, which is a horizontal cross-sectional view of the compression mechanism (20), a blade (26) extending radially outward from an outer peripheral surface of the piston (25) is integrated with the outer peripheral surface. In this embodiment, the piston (25) is made of cast iron containing graphite, but may be made of a different material.

The cylinder (22) has a circular groove in plan view. This circular groove is a bush groove (27) that houses a pair of bushes (28, 28). The pair of bushes (28, 28) that are each semicircular in plan view are fitted in the bush groove (27) with the blade (26) interposed between the bushes (28, 28). According to this configuration, the blade (26) regulates the rotation of the piston (25) on its own axis.

Figure 4:
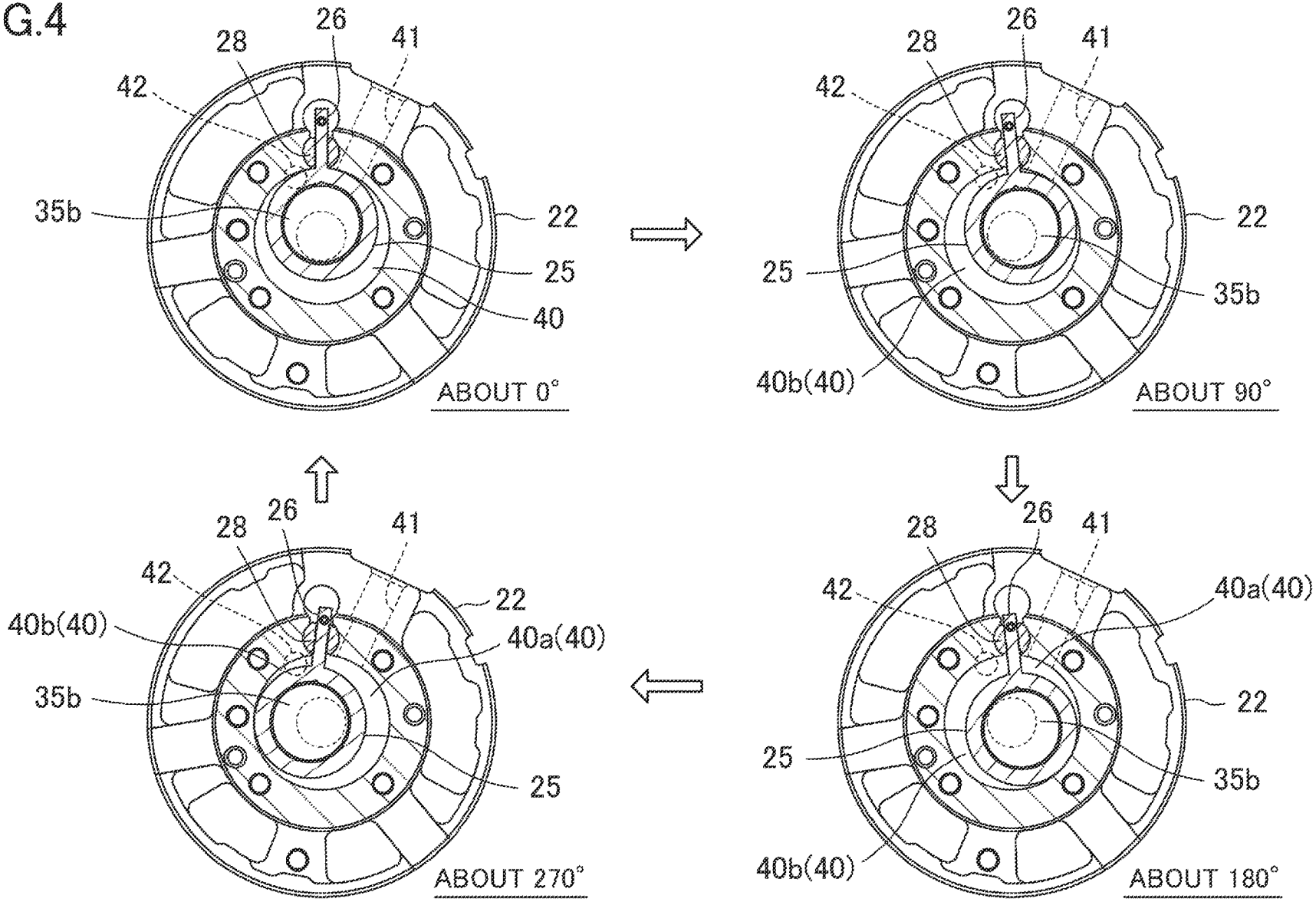
FIG. 4 illustrates how the compression mechanism operates.
Figure 5:
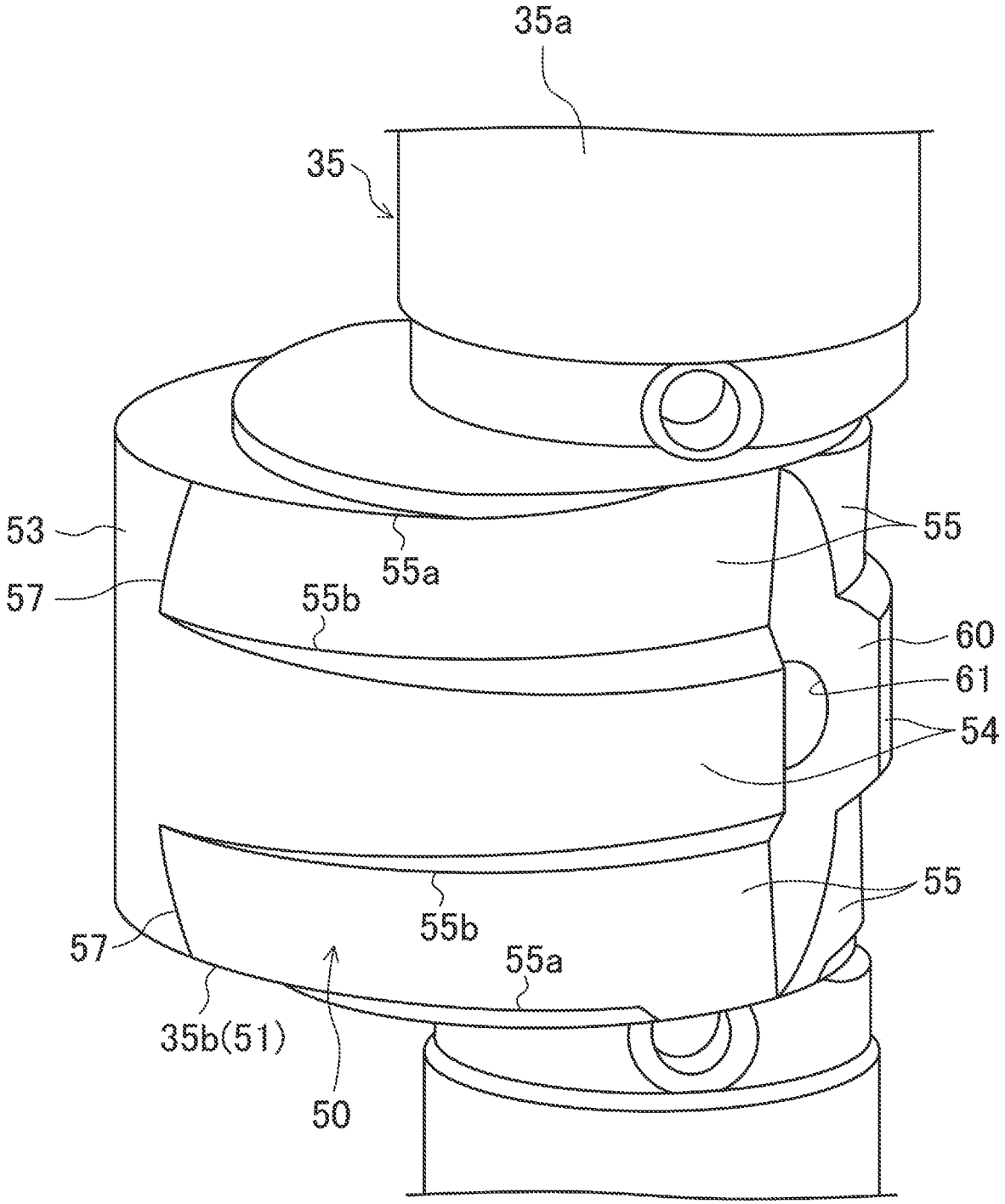
FIG. 5 is a first perspective view of an eccentric portion of a drive shaft.

The blade (26) partitions the cylinder chamber (40) into a low-pressure cylinder chamber (40*a*) and a high-pressure cylinder chamber (40*b*) (see FIG. 4). An outer peripheral wall of the cylinder (22) has a suction port (41) extending perpendicular to the center axis of the drive shaft (35) and communicating with the low-pressure cylinder chamber (40*a*).

The front head (23) has a discharge port (42) extending parallel to the center axis of the drive shaft (35) and communicating with the high-pressure cylinder chamber (40*b*). The discharge port (42) is opened and closed by a discharge valve (43).

A muffler (44) is attached to an upper surface of the front head (23) so as to cover the discharge port (42) and the discharge valve (43). The muffler (44) defines a muffler space (45), which communicates with the internal space of the casing (10) through a discharge opening (44*a*) formed in the top of the muffler.

Suction Pipe and Discharge Pipe

As illustrated in FIGS. 1 and 2, a suction pipe (14) connected to the suction port (41) is attached to the casing (10) to allow a refrigerant to pass through the suction pipe (14) and be sucked into the compression mechanism (20).

A discharge pipe (15) is attached to the casing (10) so as to penetrate the upper end plate (12). A lower end of the discharge pipe (15) is open in the interior of the casing (10). The discharge port (42) of the compression mechanism (20) communicates with the internal space of the casing (10) through the discharge opening (44*a*) of the muffler (44), and the refrigerant discharged from the compression mechanism (20) flows out of the casing (10) through the internal space of the casing (10) and the discharge pipe (15).

Structure of Sliding Portion Formed by Drive Shaft and Piston

The compression mechanism (20) includes a fitted shaft portion (51) of the drive shaft (35) and a fitted tubular portion (52) into which the fitted shaft portion (51) is fitted. The fitted shaft portion (51) and the fitted tubular portion (52) form a sliding portion (50). In this embodiment, the eccentric portion (35*b*) constitutes the fitted shaft portion (51), and the piston (25) constitutes the fitted tubular portion (52). The eccentric portion (35*b*) and the piston (25) slide on each other with an oil film interposed therebetween.

As described above, the cylinder chamber (40) includes the low-pressure cylinder chamber (40*a*) and the high-pressure cylinder chamber (40*b*). The low-pressure cylinder chamber (40*a*) has a pressure that is a low pressure of the refrigerant circuit and is almost constant, whereas the high-pressure cylinder chamber (40*b*) has a pressure that varies from the low pressure to a high pressure during a period from the start of compression of the refrigerant to the discharge of the refrigerant. For this reason, once the compression of the refrigerant starts, the pressure of the high-pressure cylinder chamber (40*b*) becomes higher than the pressure of the low-pressure cylinder chamber (40*a*). Thus, a force pushing the piston (25) against the inner surface of the cylinder (22) in a direction from the high-pressure cylinder chamber (40*b*) to the low-pressure cylinder chamber (40*a*) is applied to the piston (25). As a result, a sliding surface where the eccentric portion (35*b*) and the piston (25) slide on each other includes a portion on which a heavy load acts and a portion on which a light load acts. In this embodiment, the portion of the sliding surface on which the light load acts has a smaller area than the portion of the sliding surface on which the heavy load acts.

Specifically, as illustrated in FIGS. 5 to 8, the outer peripheral surface of the eccentric portion (35*b*) has a first sliding surface (53) and a second sliding surface (54). The first sliding surface (53) is formed as the portion on which the heavy load acts, and the second sliding surface (54) is formed as the portion on which the light load acts. The first sliding surface (53) extends across the axial width of the eccentric portion (35*b*), and is formed as a portion of the outer peripheral surface of the eccentric portion (35*b*) in the circumferential direction. The second sliding surface (54) has a smaller axial width than an axial width of the first sliding surface (53), and is formed as another portion of the outer peripheral surface of the eccentric portion (35*b*) in the circumferential direction.

The second sliding surface (54) is formed as an axial middle portion of the eccentric portion (35*b*) and has a constant width. The sliding portion (50) where the eccentric portion (35*b*) and the piston (25) slide on each other includes grooves (55) that are formed on both axial sides of the second sliding surface (54) of the outer peripheral surface of the eccentric portion (35*b*) to be adjacent to the second sliding surface (54). The grooves (55) each form a gap (56) into which the lubricating oil supplied between the eccentric portion (35*b*) and the piston (25) flows. Each of the grooves (55) forming the gap (56) is an arc-shaped groove (55) extending in the circumferential direction of the piston (25). The depth of the groove (55) increases from both circumferential ends toward a central portion of the groove (55).

Furthermore, the depth of each groove (55) increases from a first edge portion (55*a*) on the end surface of the eccentric portion (35*b*) toward a second edge portion (55*b*) on the second sliding surface (54). In other words, the bottom surface of the groove (55) is inclined such that the depth at the second edge portion (55*b*) on the second sliding surface (54) is greater than the depth at the first edge portion (55*a*) on the end surface of the eccentric portion (35*b*) (see the inclination angle $\alpha$ in FIG. 8).

The outer peripheral surface of the eccentric portion (35*b*) has an oil retainer (57) for keeping the lubricating oil in the gap (56) from flowing out toward the end surface of the eccentric portion (35*b*). The oil retainer (57) is formed at least at an end in a direction in which the lubricating oil moves toward the first sliding surface (53) during the rotation of the drive shaft (35) (the direction of the arrow A illustrated in FIG. 6), i.e., the rear end in the direction in which the eccentric portion (35*b*) turns in FIG. 4. In this embodiment, the oil retainer (57) is formed at both circumferential ends of each groove (55). The oil retainer (57) is formed at a boundary portion between the first sliding surface (53) and the groove (55) forming the gap (56).

In this embodiment, the groove (55) forming the gap (56) is configured such that the circumferential length of the second edge portion (55*b*) on the second sliding surface (54) is longer than the circumferential length of the first edge portion (55*a*), which is on the end surface of the eccentric portion (35*b*), that is, an edge portion of the gap (56) in the lubricating oil flow-out direction. Thus, the boundary portion forming the oil retainer (57) lies on a line inclined with respect to the center axis of the drive shaft (35). Note that the eccentric portion (35*b*) has a notch (60) and an oil supply hole (61), both for supplying the lubricating oil in the oil supply path (37) to the sliding portion (50).

The grooves (55) can be formed using a lathe. Using the lathe enables simultaneous formation of the groove (55) and the oil retainer (57) by three-axis machining using the lathe, and the groove (55) is formed to have varied depths, which enables the formation of the boundary portion of the oil retainer (57) on the inclined line. Thus, the groove (55) and the oil retainer (57) can be easily formed.

Operation

In the compressor (1) of this embodiment, the actuation of the electric motor (30) causes the rotor (32) to rotate. This rotation is transmitted to the piston (25) of the compression mechanism (20) via the drive shaft (35). The piston (25) is fitted to the eccentric portion (35*b*) of the drive shaft (35), and thus turns in an orbit around the center of rotation of the drive shaft (35). In addition, since the blade (26) integrated with the piston (25) is held by the bushes (28), the piston (25) does not rotate on its own axis but revolves (rotates eccentrically) while swinging.

During the rotation of the piston (25) of the compression mechanism (20), the piston (25) moves from the state at an angle of 0° through the states at angles of 90°, 180°, and 270°, and back to the state at an angle of 0° as illustrated in FIG. 4. In this manner, the volume of the high-pressure cylinder chamber (40*b*) decreases as the volume of the low-pressure cylinder chamber (40*a*) increases, and this operation is repeatedly performed. The refrigerant is sucked into the low-pressure cylinder chamber (40*a*), is compressed in the high-pressure cylinder chamber (40*b*), and is then discharged. Due to the compression of the refrigerant, a load pushing the piston (25) from the high-pressure cylinder chamber (40*b*) toward the low-pressure cylinder chamber (40*a*) is applied to the piston (25).

The refrigerant discharged from the discharge port (42) passes through the muffler space (45) formed in the muffler (44) and flows out of the compression mechanism (20) into the space in the casing (10).

The refrigerant in the casing (10) flows into the refrigerant circuit through the discharge pipe (15). The refrigerant circulates through the refrigerant circuit to perform a refrigeration cycle.

Movement of Lubricating Oil at Sliding Portion

When the drive shaft (35) rotates, the lubricating oil is supplied through the oil supply path (37) to the sliding portion (50). The lubricating oil flows into the grooves (55). Relatively to the drive shaft (35), the lubricating oil in each groove (55) is caused to move from the rear end, of the groove (55), in the direction of rotation of the drive shaft (35), further toward the direction of the arrow A illustrated in FIG. 6, and to the first sliding surface (53). Due to the effect of the oil retainer (57) formed along the inclined line, the lubricating oil moves along the inclined line and flows in a direction that makes the lubricating oil remain in the groove (55). This makes it difficult for the lubricating oil to flow out of the end of the groove (55). The pressure of the lubricating oil at the end of the groove (55) therefore increases.

In general, the lubricating oil in the compressor (1) will be diluted by containing the refrigerant. In the known configuration without an oil retainer (57), the refrigerant easily flows out of the grooves (55), resulting in a reduction in the amount of the lubricating oil and causing vaporization of the refrigerant with a reduction in pressure. As a result, the resultant refrigerant gas may flow to the first sliding surface (53) to cause poor lubrication.

In this embodiment, the lubricating oil accumulates at the end of each groove (55), and the pressure of the lubricating oil increases at the end of the groove (55). The refrigerant is thus less likely to vaporize. In addition, the refrigerant with a low specific gravity hardly enters the lubricating oil having a high pressure at the end of the groove (55). As a result, the refrigerant gas flowing onto the first sliding surface (53) is reduced. Thus, a sliding portion between the eccentric portion (35*b*) and the piston (25) is lubricated sufficiently.

Advantages of Embodiment

The compressor (1) of this embodiment includes the drive shaft (35) and the compression mechanism (20). The drive shaft (35) has the main shaft (35*a*), and the eccentric portion (35*b*) eccentric to the center of the main shaft (35*a*). The compression mechanism (20) includes the piston (25) as the fitted tubular portion (52) into which the eccentric portion (35*b*) of the drive shaft (35) serving as the fitted shaft portion (51) is fitted. The eccentric portion (35*b*) and the piston (25) slide on each other with an oil film interposed therebetween.

The eccentric portion (35*b*) has the first sliding surface (53) formed as a portion, in the circumferential direction, of the outer peripheral surface of the eccentric portion (35*b*), and the second sliding surface (54) formed as another portion of the outer peripheral surface in the circumferential direction. The second sliding surface (54) has a smaller axial width than an axial width of the first sliding surface (53). The sliding portion (50) between the piston (25) and the eccentric portion (35*b*) has the gap (56) which is adjacent to the second sliding surface (54) in an axial direction and into which the lubricating oil flows, and the oil retainer (57) for keeping the lubricating oil in the gap (56) from flowing out toward the end surface of the eccentric portion (35*b*).

In the known compressor (1) of this type, the lubricating oil tends to flow out of the gap (56) that is formed between the eccentric portion (35*b*) and the piston (25) due to formation of an axially narrower sliding surface. It is therefore difficult to supply the lubricating oil sufficiently to a portion of the sliding surface to which a heavy load is applied (the axially wider first sliding surface (53)). In particular, in the compressor (1) that compresses the refrigerant, if the lubricating oil diluted by the refrigerant flows easily out of the gap (56), the refrigerant may vaporize with a reduction in pressure, and the resultant refrigerant gas may spread over the sliding surface to cause poor lubrication, resulting in a decrease in reliability. To address this problem, it is desired to improve the performance of the compressor by making it possible to form an axially wider sliding surface and an axially narrower sliding surface, while reducing a decrease in the reliability of the sliding surface, and thereby reducing unnecessary oil shear losses at the sliding portion.

Mass production of bearings including the first sliding surface (53) and the second sliding surface (54) having different axial widths at low cost has been desired. However, it is difficult to produce such a bearing structure in volume at low cost.

Figure 6:
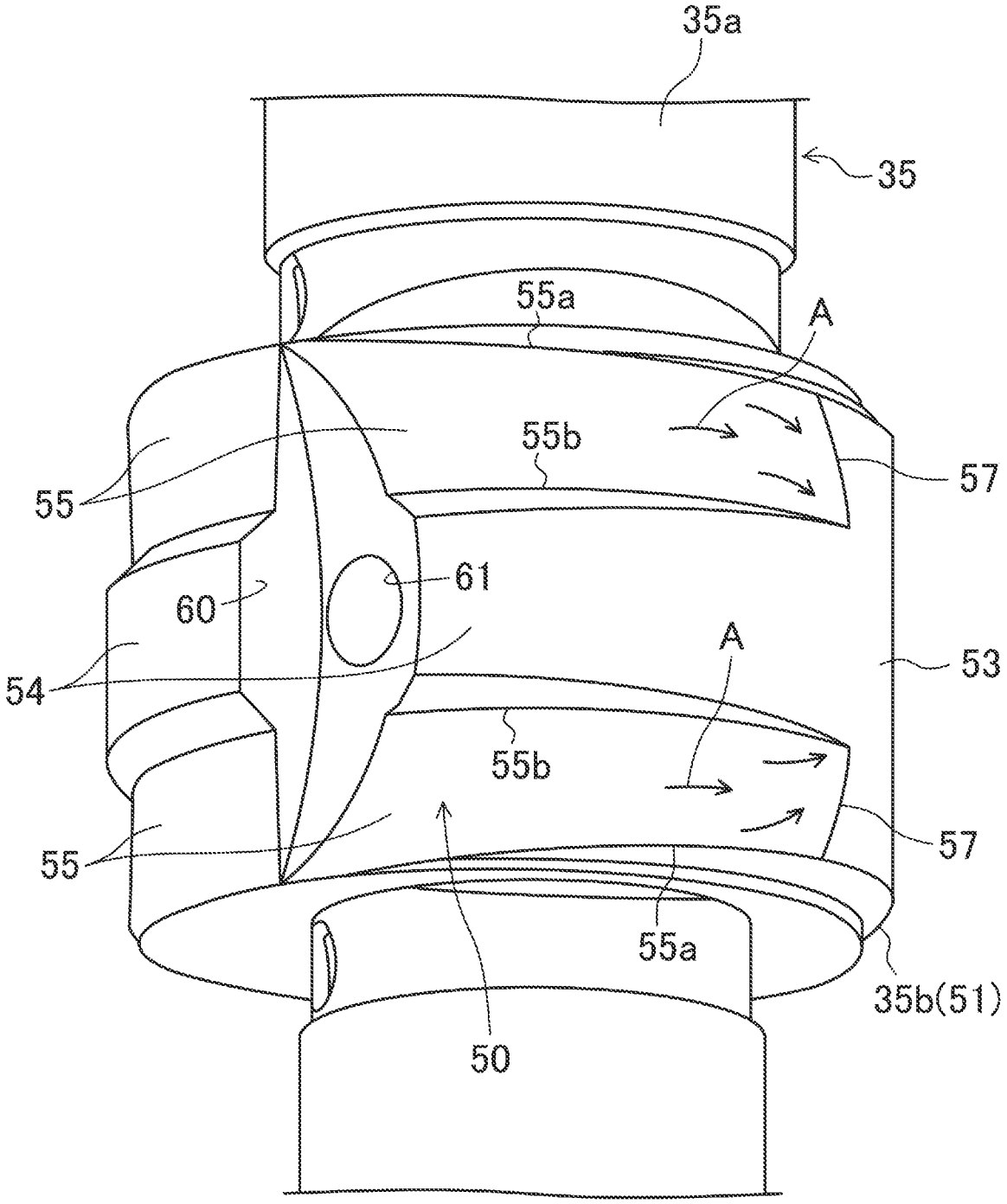
FIG. 6 is a second perspective view of the eccentric portion illustrated in FIG. 5.

According to this embodiment, when the drive shaft (35) rotates, and the lubricating oil accumulates in the gap (56), the oil retainer (57) reduces the lubricating oil flowing out of the gap (56) at the end of the gap (56) as indicated by the arrow A in FIG. 6. The pressure of the lubricating oil accumulated at the end of the gap (56) therefore increases. The refrigerant gas with a low specific gravity hardly enters the lubricating oil with an increased pressure at the end of the gap (56). Thus, almost only the lubricating oil is supplied from the oil retainer (57) to the first sliding surface (53). This can reduce the refrigerant gas flowing onto the first sliding surface (53). As a result, poor lubrication is less likely to occur. This reduces a decrease in the reliability of the sliding portion (50), and improves the performance of the compressor.

In this embodiment, the second sliding surface (54) is formed at the axial middle portion of the eccentric portion (35*b*), and oil retainer (57) is configured as the boundary portion between the first sliding surface (53) and the gap (56). The boundary portion has a central portion that is inclined in a direction protruding further toward the first sliding surface (53) than an end of the boundary portion in the lubricating oil flow-out direction.

According to this embodiment, the boundary portion between the first sliding surface (53) and the gap (56) has a central portion that is inclined so as to protrude beyond an edge of the gap (56) on the lubricating oil flow-out side. Thus, the lubricating oil is less likely to flow out of the gap (56) during the rotation of the drive shaft (35), and can be effectively accumulated in the gap (56). The refrigerant gas flowing onto the first sliding surface (53) is therefore reduced, which can ensure the reliability of the sliding portion (50).

In this embodiment, the gap (56) is configured as an arc-shaped groove (55) extending in the circumferential direction of the eccentric portion (35*b*), and the groove (55) has a depth that varies in the axial direction.

The second sliding surface (54) is formed as an axial middle portion of the eccentric portion (35*b*). The grooves (55) are formed on both sides of the second sliding surface (54) in the axial direction of the eccentric portion (35*b*), and the depth of each groove (55) increases from the first edge portion (55*a*) on the end surface of the eccentric portion (35*b*) toward the second edge portion (55*b*) on the second sliding surface (54).

According to this embodiment, the gap (56) is configured as an arc-shaped groove (55) formed in the outer surface of the eccentric portion (35*b*). It is possible to form the arc-shaped groove (55) and the oil retainer (57) by one machining process with a lathe, and thus possible to increase the reliability of the sliding portion (50) by low-cost machining. In particular, the inclined oil retainer (57) formed at the boundary portion between the first sliding surface (53) and the gap (56) can be easily formed by the machining process with a lathe. The machining process with the lathe enables the formation of a plurality of grooves by one chucking process. Thus, even the drive shaft (35) having a plurality of grooves (55) can be produced in volume at low cost. Moreover, even in a case where the groove (55) is difficult to be formed in the eccentric portion (35*b*) by so-called "near-net shape forming," the groove (55) can be formed by the lathe machining at low cost, and good sliding characteristics due to graphite are obtainable at the sliding portion (50) having the axially narrower second sliding surface (54).

VARIATIONS OF EMBODIMENT

First Variation

For example, the sliding portion (50) may have the configuration illustrated in FIGS. 9 to 12.

Figure 12:
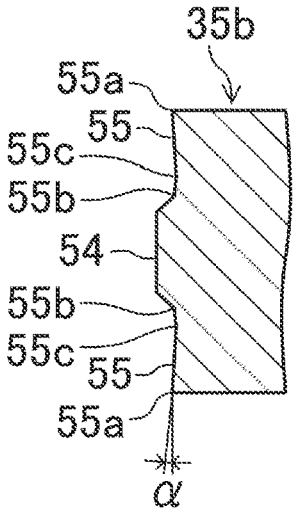
FIG. 12 is a cross-sectional view taken along line XII-XII illustrated in FIG. 11.
Figure 13:
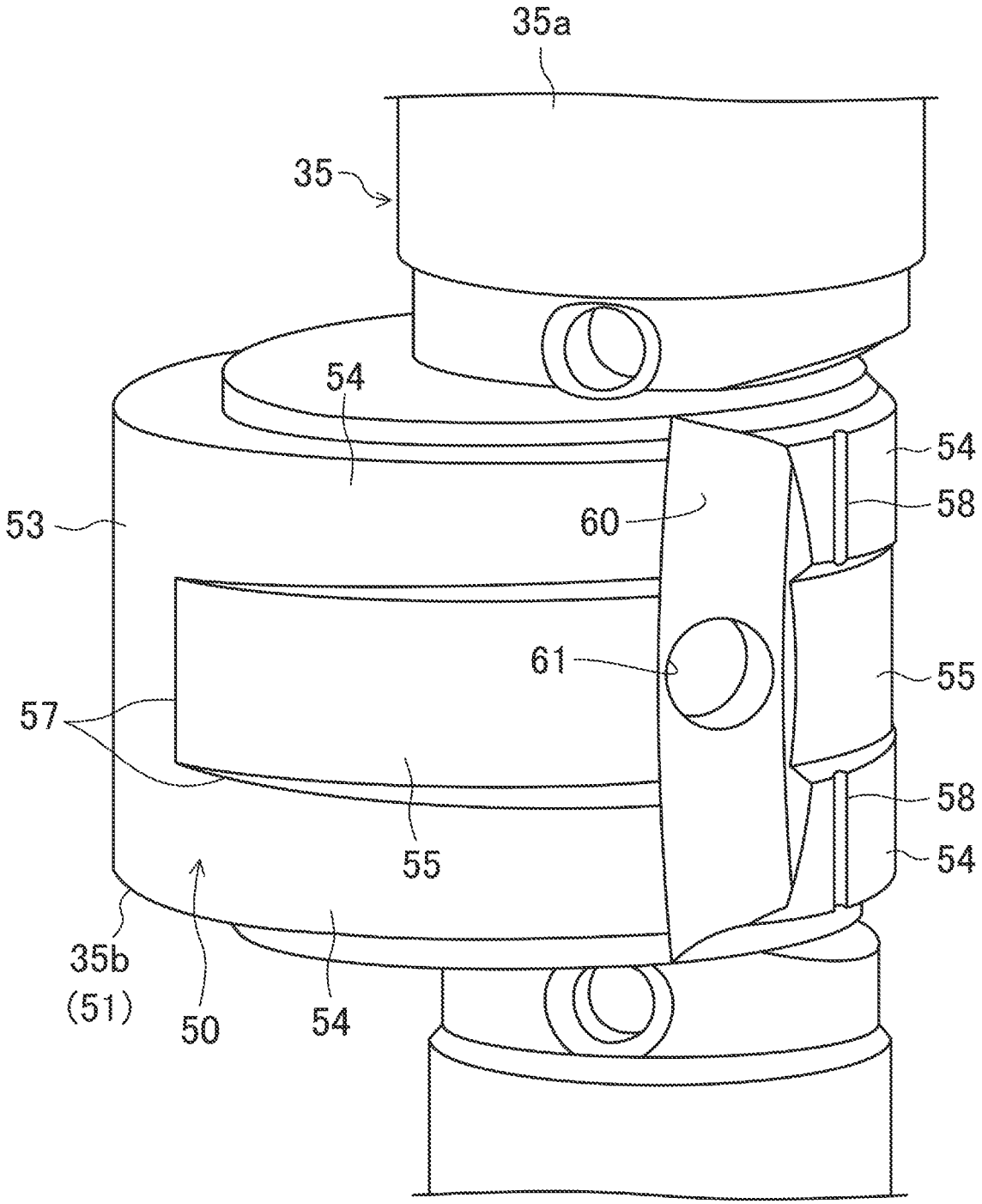
FIG. 13 is a first perspective view of an eccentric portion of a drive shaft according to a second variation.
Figure 14:
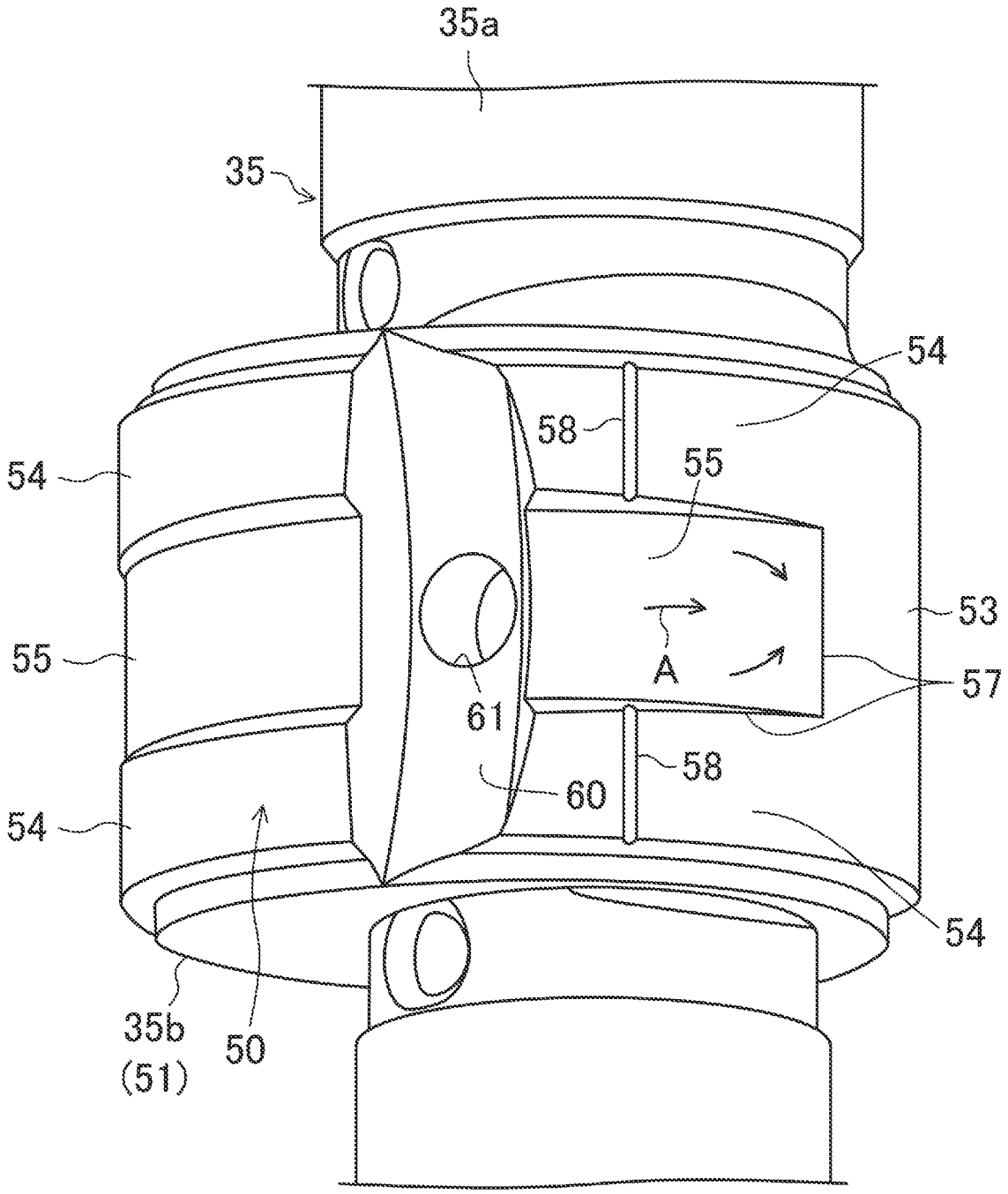
FIG. 14 is a second perspective view of the eccentric portion illustrated in FIG. 13.
Figure 15:
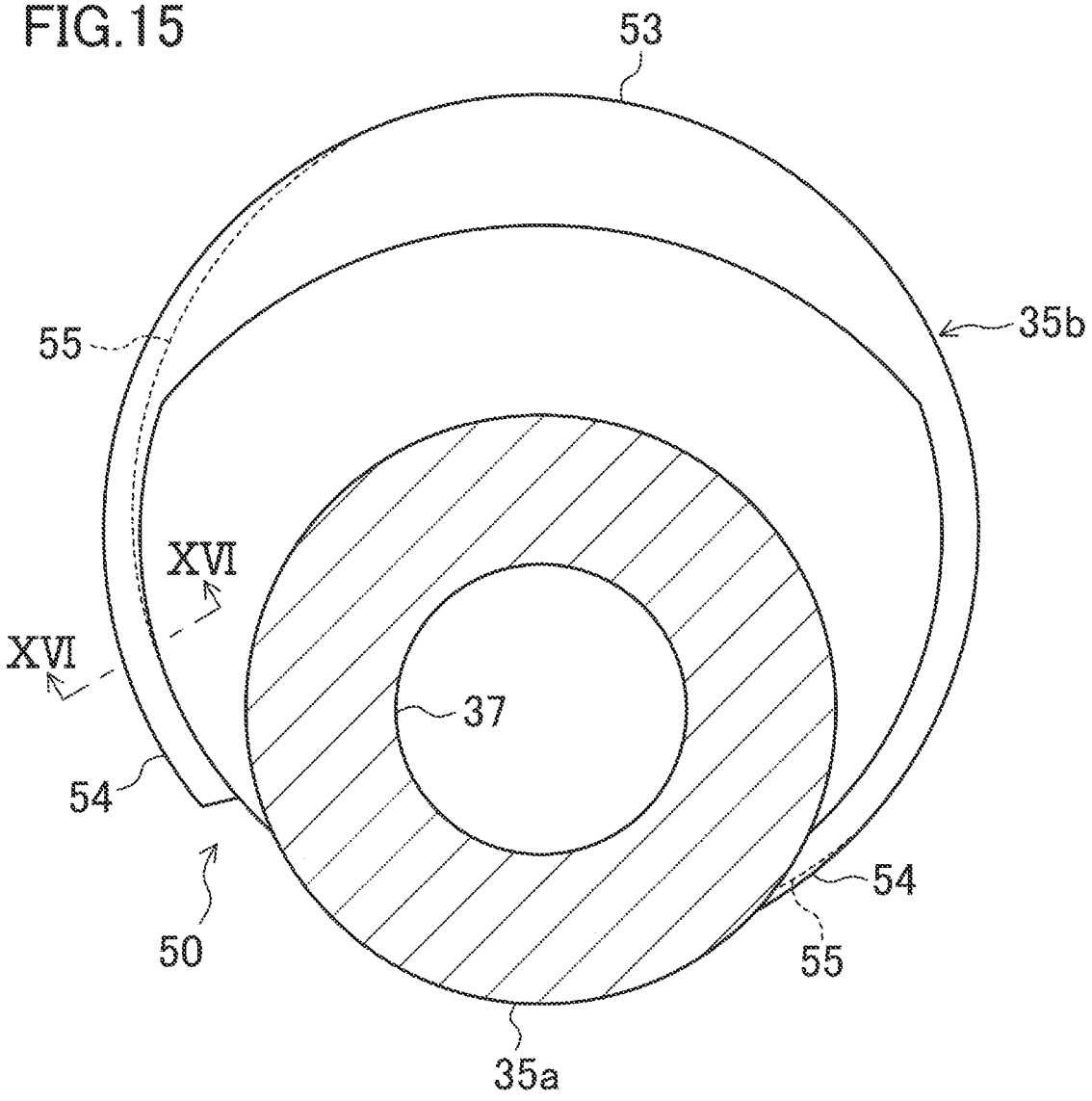
FIG. 15 is a cross-sectional view of the drive shaft taken along a plane above the eccentric portion.
Figure 16:
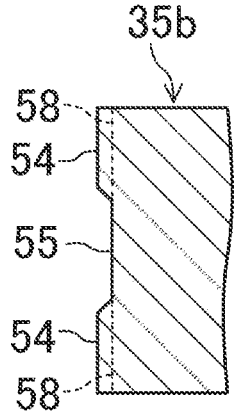
FIG. 16 is a cross-sectional view taken along line XVI-XVI illustrated in FIG. 15.

This variation is the same as the foregoing embodiment in that the second sliding surface (54) is formed at an axial middle portion of an eccentric portion (35*b*). In contrast, the grooves (55) formed on both sides of the second sliding surface (54) in the axial direction of the eccentric portion (35*b*) are different in shape from the grooves (55) of the foregoing embodiment. Specifically, as illustrated in FIG. 12, each groove (55) has a depth increased from the first edge portion (55*a*) on the end surface of the eccentric portion (35*b*) and from the second edge portion (55*b*) on the second sliding surface (54) toward a groove bottom (55*c*) that is an intermediate portion between the first edge portion (55*a*) and the second edge portion (55*b*).

The groove (55) configured as described above is an arc-shaped groove on the outer surface of the eccentric portion (35*b*), which creates the gap (56) similarly to the foregoing embodiment. In this variation, too, it is possible to form the arc-shaped groove (55) and the oil retainer (57) by one machining process with a lathe, and thus possible to increase the reliability of the sliding portion (50) by low-cost machining. In particular, the oil retainer (57) of the second aspect formed at the boundary portion between the first sliding surface (53) and the gap (56) can be easily formed by machining with a lathe.

Second Variation

The sliding portion (50) may have the configuration illustrated in FIGS. 13 to 16.

In this variation, the second sliding surfaces (54) are formed at both axial end portions of the eccentric portion (35*b*). The gap (56) is formed at an axial middle portion of the eccentric portion (35*b*) and is configured as an arc-shaped groove (55) extending in the circumferential direction of the eccentric portion (35*b*). In this variation, the eccentric portion (35*b*) has slits, through which the groove (55) communicates with the outside of the piston (25). The slits are configured as communication passages (58) for discharging gas. The communication passages (58) may be passages not exposed on the outer peripheral surface of the eccentric portion (35*b*). The communication passages (58) may be formed on the piston (25).

In this configuration, a gap (56) is formed in the axial middle portion of the eccentric portion (35*b*), and the gap (56) forms an oil retainer (57). A refrigerant gas hardly enters the lubricating oil accumulated in the oil retainer (57) at the end of the gap (56). Thus, the refrigerant gas flowing onto the first sliding surface (53) is reduced. Furthermore, in this variation, the second sliding surfaces (54) formed at both axial end portions of the eccentric portion (35*b*) can lengthen the bearing span. It is thus possible to reduce the inclination of the drive shaft (35).

Third Variation

The sliding portion (50) may have the configuration indicated by the phantom lines in FIGS. 1 and 2.

In this variation, the fitted tubular portion (52) is comprised of a bearing (23*a*) of the front head (23), and the fitted shaft portion (51) is comprised of the main shaft (35*a*) of the drive shaft (35). The main shaft (35*a*) that serves as the fitted shaft portion (51) has the gap (56) and the oil retainer (57) described in the foregoing embodiment and its variations.

In this configuration, the lubricating oil is retained in the oil retainer (57) on the sliding portion (50) between the main shaft (35*a*) of the drive shaft (35) and the bearing (23*a*) of the front head (23), and the vaporization of the refrigerant with a reduction in pressure is therefore reduced similarly to the foregoing embodiment and its variations. Thus, the resultant refrigerant gas flowing onto the first sliding surface (53) is reduced. As a result, the reliability of the sliding surface between the main shaft (35*a*) of the drive shaft (35) and the bearing (23*a*) of the front head (23) can be improved.

Other Embodiments

The foregoing embodiment may be modified as follows.

Figure 17:
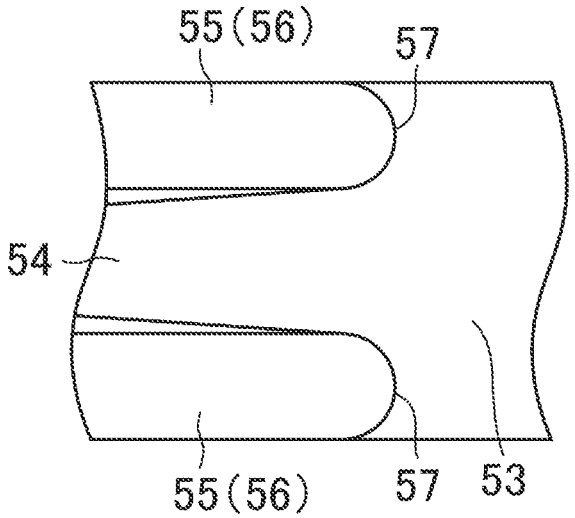
FIG. 17 illustrates a variation of grooves.

In the foregoing embodiment, the boundary portion between the first sliding surface (53) and the gap (56), which serves as the oil retainer (57), does not have to be formed on an inclined line. For example, as illustrated in FIG. 17, which is a partial development view of the outer peripheral surface of the eccentric portion (35*b*), each of the boundary portions may draw a curved (or bent) line so that the boundary line of the first sliding surface (53) is recessed, or conversely, the boundary line of the gap (56) protrudes. In summary, the boundary portion may have any shape as long as a central portion of the boundary portion protrudes further toward the first sliding surface (53) than an end of the boundary portion in the lubricating oil flow-out direction.

In the foregoing embodiment, the second sliding surface (54) is formed at the axial middle portion of the piston (25) and has a constant width. However, the second sliding surface (54) does not necessarily have to have a constant width.

Figure 7:
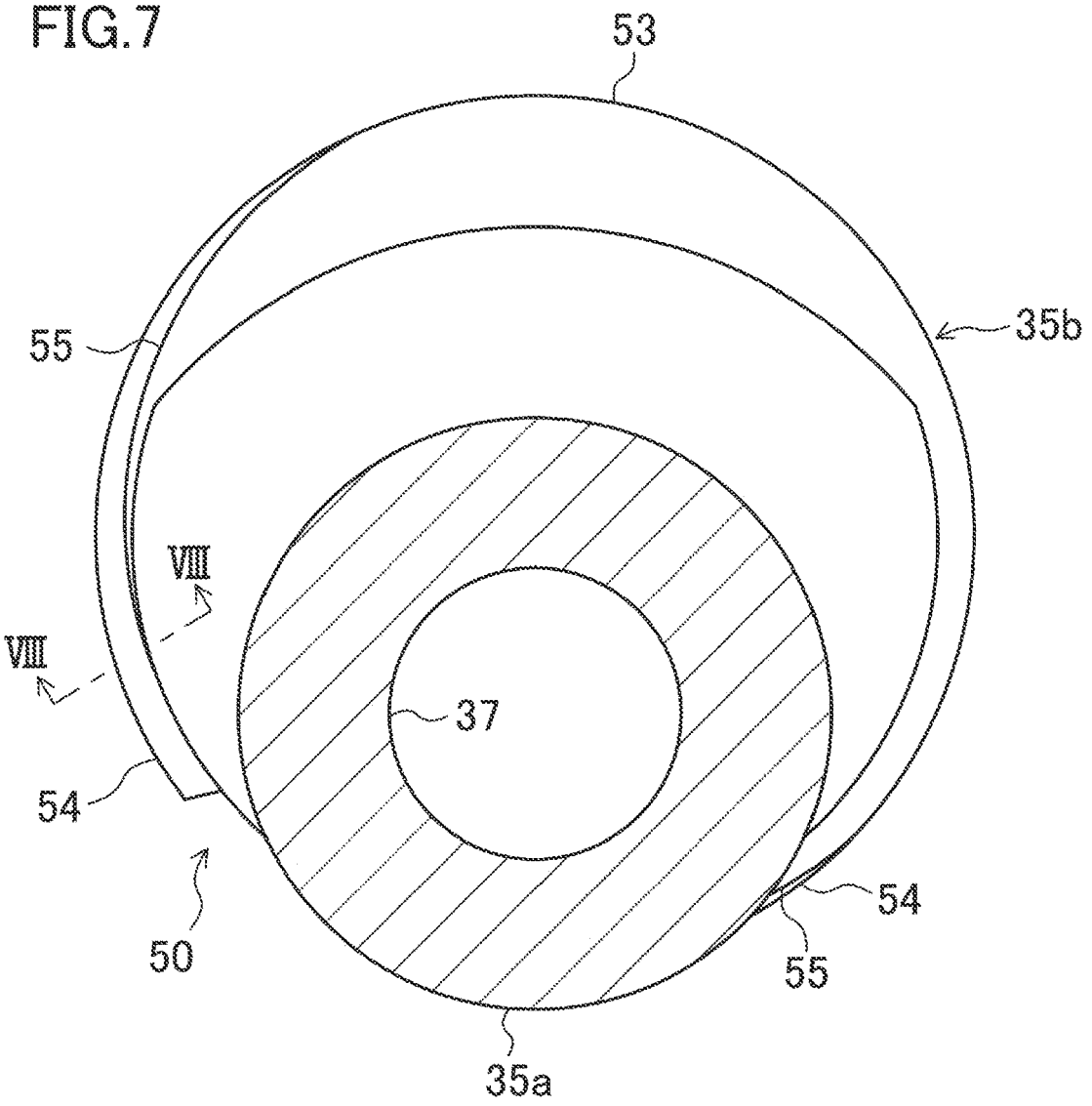
FIG. 7 is a cross-sectional view of the drive shaft taken along a plane above the eccentric portion.
Figure 8:
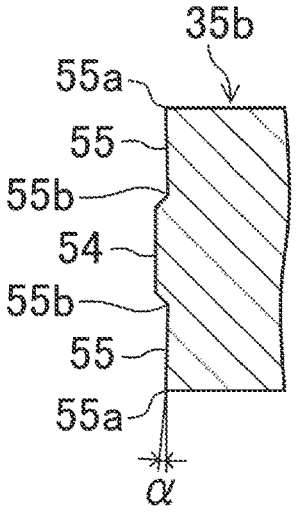
FIG. 8 is a cross-sectional view taken along line VIII-VIII illustrated in FIG. 7.
Figure 9:
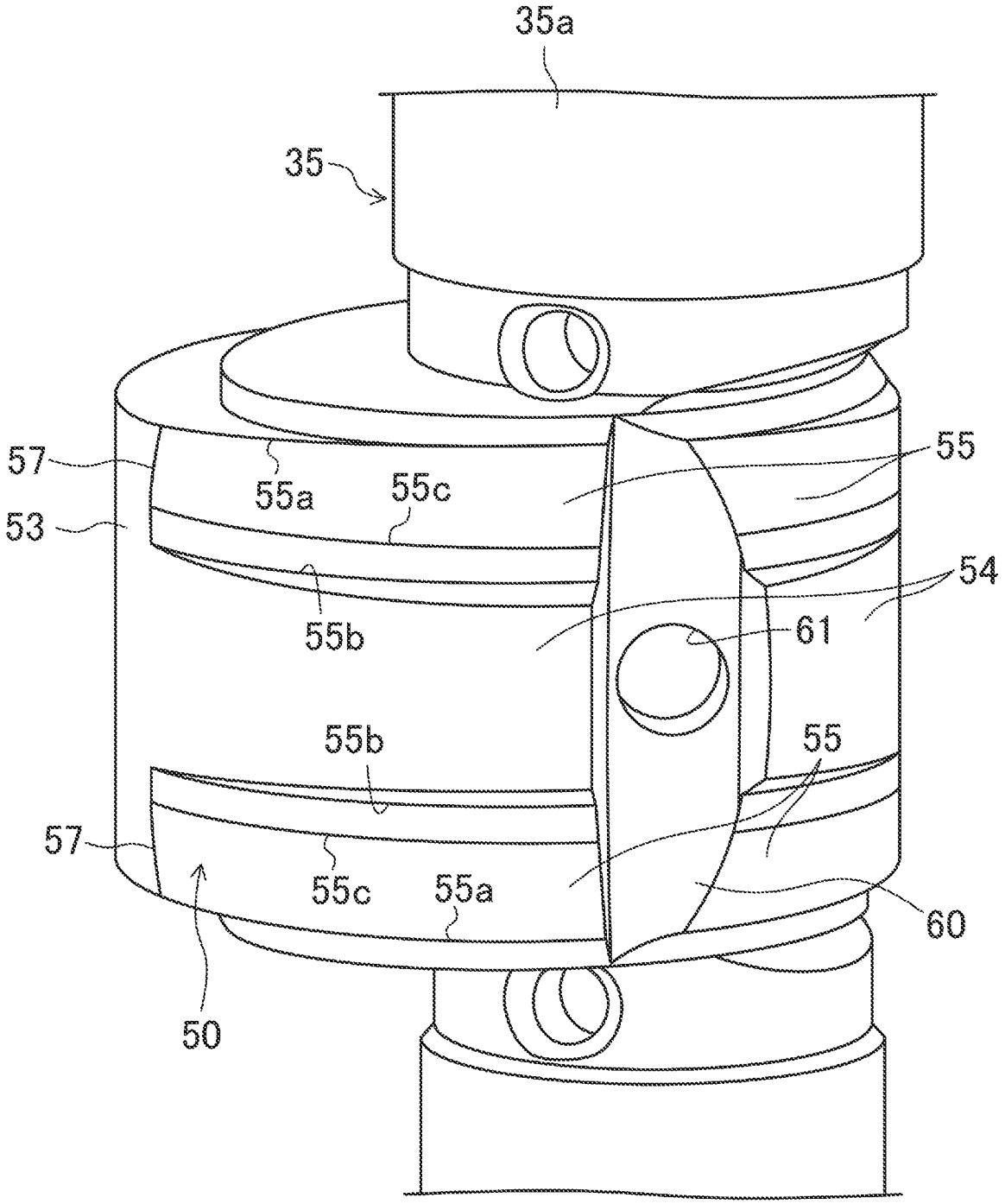
FIG. 9 is a first perspective view of an eccentric portion of a drive shaft according to a first variation.
Figure 10:
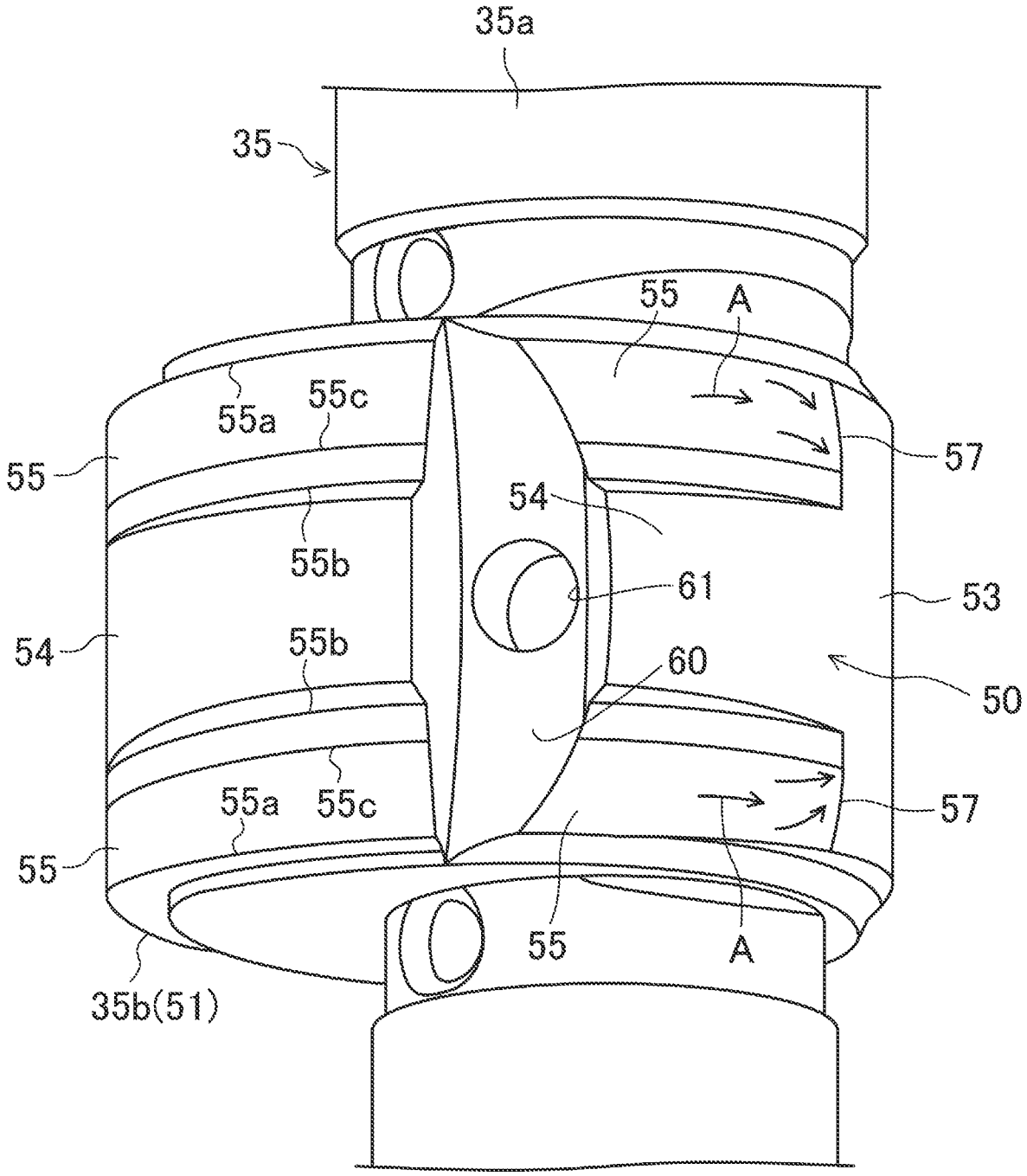
FIG. 10 is a second perspective view of the eccentric portion illustrated in FIG. 9.
Figure 11:
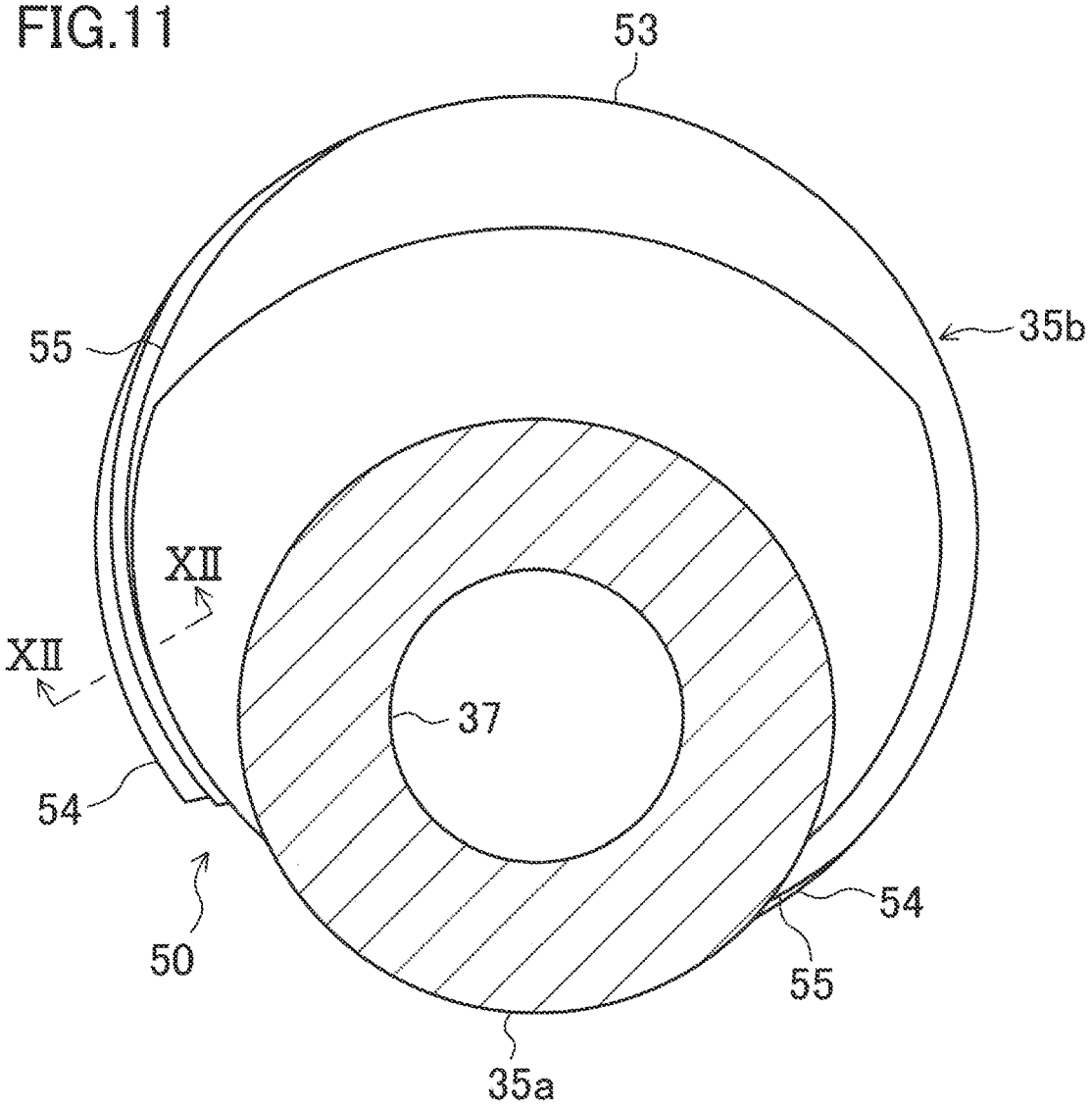
FIG. 11 is a cross-sectional view of the drive shaft taken along a plane above the eccentric portion.

The oil retainer (57) does not have to be formed at both ends of the groove (55) as long as the oil retainer (57) is formed at an end in a direction in which the lubricating oil moves toward the first sliding surface (53) during rotation of the drive shaft (35) (the direction indicated by the arrow A illustrated in FIG. 7).

The sliding structure of the present disclosure can be used not only for the swing piston compressor of the foregoing embodiment, but also for a rolling piston compressor comprising a piston (25) and a blade that are separate members from each other, and is applicable to an eccentric portion (35*b*) of the drive shaft (35) fitted to the piston (25) or a main shaft (35*a*) of the drive shaft (35) fitted to a bearing. The sliding structure of the present disclosure can further be used for a two-cylinder swing piston compressor (1) comprising two compression mechanisms (20) arranged along the axis of a drive shaft (35), and is applicable to an eccentric portion (35*b*) of the drive shaft (35) fitted to the piston (25). Further, the sliding structure of the present disclosure can be used for a scroll compression mechanism, and is applicable to an eccentric portion of the drive shaft fitted to a movable scroll or a main shaft of the drive shaft fitted to a bearing. As can be seen from the foregoing description, the sliding structure of the present disclosure is applicable to various types of sliding portions of a compressor.

The second sliding surface (54) of the main shaft (35*a*) of the drive shaft (35) fitted to the bearing (23*a*, 24*a*) can be positioned not at an axial middle portion of the bearing (23*a*, 24*a*) but at a position closer to the cylinder (22). This configuration can shorten the interval between the bearings, compared to forming the second sliding surface (54) at the axial middle portion of the bearing (23*a*, 24*a*), and can reduce the deflection of the drive shaft (35) and reduce damage caused by partial contact with the bearing.

While the embodiment and variations thereof have been described above, it will be understood that various changes in form and details may be made without departing from the spirit and scope of the claims. The foregoing embodiments and variations thereof may be combined and replaced with each other without deteriorating the intended functions of the present disclosure.

As can be seen from the foregoing description, the present disclosure is useful for a compressor.

The invention claimed is:

1. A compressor, comprising:

a drive shaft having a main shaft and an eccentric portion that is eccentric relative to a center of the main shaft; and a compression mechanism having a fitted tubular portion into which a fitted shaft portion of the drive shaft is fitted, the fitted shaft portion of the drive shaft and the fitted tubular portion sliding relative to each other with an oil film interposed therebetween, the fitted shaft portion having a first sliding surface formed as a portion, in a circumferential direction, of an outer peripheral surface of the fitted shaft portion, and a second sliding surface formed as an other portion of the outer peripheral surface in the circumferential direction, the second sliding surface having a smaller axial width than an axial width of the first sliding surface, a gap adjacent to the second sliding surface in an axial direction and into which a lubricating oil flows, and an oil retainer configured to keep the lubricating oil in the gap from flowing out toward an end surface of the fitted shaft portion;

the second sliding surface being provided at an axial middle portion of the fitted shaft portion, the oil retainer being configured as a boundary portion between the first sliding surface and the gap, and the boundary portion having a central portion that protrudes further toward the first sliding surface than an end of the boundary portion in a lubricating oil flow-out direction.

2. The compressor of claim 1, wherein the gap is configured as a groove having an arc shape and extending in the circumferential direction of the fitted shaft portion, and the groove has a depth that varies in the axial direction.

3. The compressor of claim 2, wherein the second sliding surface is provided at an axial middle portion of the fitted shaft portion, and the groove includes a plurality of grooves, the grooves being formed on both sides of the second sliding surface in the axial direction of the fitted shaft portion, and each of the grooves having a depth that increases from a first edge portion on an end surface of the fitted shaft portion toward a second edge portion on the second sliding surface.

4. The compressor of claim 2, wherein the second sliding surface is provided at an axial middle portion of the fitted shaft portion, and the groove includes a plurality of grooves, the grooves being formed on both sides of the second sliding surface in the axial direction of the fitted shaft portion, and each of the grooves having a depth that increases from a first edge portion on an end surface of the fitted shaft portion and from a second edge portion on the second sliding surface toward an intermediate portion between the first edge portion and the second edge portion.

5. The compressor of claim 1, wherein the compression mechanism includes a piston having an annular shape and a cylinder housing the piston, rotation of the piston on its own axis being regulated, the fitted tubular portion is the piston, and the fitted shaft portion is the eccentric portion of the drive shaft.

6. The compressor of claim 1, wherein the compression mechanism includes a piston having an annular shape and a cylinder housing the piston, the fitted tubular portion is a tubular bearing of the cylinder, and the fitted shaft portion is the main shaft of the drive shaft.

* * * * *